US010301940B2

(12) United States Patent
Tanaka

(10) Patent No.: US 10,301,940 B2
(45) Date of Patent: May 28, 2019

(54) SCROLL EXPANDER

(71) Applicant: SANDEN HOLDINGS CORPORATION, Isesaki-shi (JP)

(72) Inventor: Yuuta Tanaka, Isesaki (JP)

(73) Assignee: SANDEN HOLDINGS CORPORATION, Gunma (JP)

( * ) Notice: Subject to any disclaimer, the term of this patent is extended or adjusted under 35 U.S.C. 154(b) by 287 days.

(21) Appl. No.: 15/118,412

(22) PCT Filed: Feb. 9, 2015

(86) PCT No.: PCT/JP2015/053457
§ 371 (c)(1),
(2) Date: Aug. 11, 2016

(87) PCT Pub. No.: WO2015/122373
PCT Pub. Date: Aug. 20, 2015

(65) Prior Publication Data

US 2017/0167262 A1 Jun. 15, 2017

(30) Foreign Application Priority Data

Feb. 12, 2014 (JP) ..... 2014-024454

(51) Int. Cl.
*F01C 20/26* (2006.01)
*F01C 21/10* (2006.01)
(Continued)

(52) U.S. Cl.
CPC ..... *F01C 20/26* (2013.01); *F01C 1/02* (2013.01); *F01C 1/0215* (2013.01);
(Continued)

(58) Field of Classification Search
CPC ..... F01C 20/10; F01C 20/26; F01C 21/10; F01C 1/0215; F01N 13/087
(Continued)

(56) References Cited

U.S. PATENT DOCUMENTS 7,104,060 B2 * 9/2006 Ogawa ..... F01C 11/002 418/55.2
2004/0255591 A1 12/2004 Hisanaga et al.
(Continued)

FOREIGN PATENT DOCUMENTS

CN 102384084 3/2012
JP 2005-30386 2/2005
(Continued)

OTHER PUBLICATIONS

Office Action dated Dec. 26, 2017 which issued in the corresponding Chinese Patent Application No. 201580008208.0.

*Primary Examiner* — Deming Wan
(74) *Attorney, Agent, or Firm* — Cozen O'Connor

(57) ABSTRACT

Scroll expander including a bypass passage and a bypass valve configured to open and close the bypass passage without significantly increasing the length in the shaft direction of the scroll expander. Scroll expander 23 includes suction port 513 which allows a high-pressure flow of a working fluid to enter and guides the entering flow of the working fluid into an expansion chamber. Discharge port 523 allows the working fluid expanded to a lower pressure in the expansion chamber to flow out. Bypass passage 27 communicates suction port 513 with the discharge port 523 while bypassing the expansion chamber. Bypass valve 28 is configured to open and close bypass passage 27. Suction port 513, bypass passage 27 and a bypass valve attaching portion 514 for attaching the bypass valve 28 are formed in a base plate of the fixed scroll 51.

7 Claims, 9 Drawing Sheets

(51) Int. Cl.

| | |
|---|---|
| ***F01N 13/08*** | (2010.01) |
| ***F01C 1/02*** | (2006.01) |
| ***F01C 20/10*** | (2006.01) |
| ***F01C 20/28*** | (2006.01) |
| ***F01C 21/18*** | (2006.01) |

(52) U.S. Cl.
CPC ..... *F01C 1/0261* (2013.01); *F01C 20/10* (2013.01); *F01C 20/28* (2013.01); *F01C 21/10* (2013.01); *F01C 21/18* (2013.01)

(58) Field of Classification Search
USPC ..... 418/55.1–55.6, 180, 15, 185–188
See application file for complete search history.

(56) References Cited

U.S. PATENT DOCUMENTS

| | | | | |
|---|---|---|---|---|
| 2007/0175212 | A1 | 8/2007 | Uno et al. | |
| 2008/0310966 | A1* | 12/2008 | Iwano ..... | F04C 28/06 417/12 |
| 2012/0031141 | A1 | 2/2012 | Wada | |
| 2015/0033743 | A1 | 2/2015 | Wada et al. | |

FOREIGN PATENT DOCUMENTS

| | | |
|---|---|---|
| JP | 2007-231855 | 9/2007 |
| JP | 2010-236360 | 10/2010 |
| JP | 4689498 | 5/2011 |
| JP | 2013-189930 | 9/2013 |
| JP | 2013-189931 | 9/2013 |

* cited by examiner (X-X CROSS SECTION)

SCROLL EXPANDER

RELATED APPLICATIONS

This is a U.S. National Phase Application under 35 USC 371 of International Application PCT/JP2015/053457 filed on Feb. 9, 2015.

This application claims the priority of Japanese application no. 2014-024454 filed Feb. 12, 2014, the entire content of which is hereby incorporated by reference.

TECHNICAL FIELD

The present invention relates to a scroll expander, particularly to a scroll expander suitably incorporated in Rankine cycle.

BACKGROUND ART

There has been conventionally known a scroll expander as disclosed in Patent Document 1. The scroll expander disclosed in Patent Document 1 is integrally provided with a high pressure portion into which a high-pressure working fluid (refrigerant) is introduced, a drive portion driven by expansion of the working fluid supplied from the high pressure portion; a low pressure portion allowing the working fluid to flow out of the scroll expander after being expanded to a lower pressure in the drive portion; a communication passage (bypass passage) through which the high-pressure portion communicates with the low-pressure portion while bypassing the drive portion; and a valve mechanism (bypass valve) configured to open and close the communication passage.

REFERENCE DOCUMENT LIST

Patent Document

Patent Document 1: JP 4689498 B

SUMMARY OF THE INVENTION

Problems to be Solved by the Invention

However, the conventional scroll expander includes an additional housing on the back surface of a base plate of the fixed scroll. The housing and the base plate of the fixed scroll define the high-pressure portion therebetween, and the valve mechanism is attached to the housing. This configuration increases the length in the shaft direction of the conventional scroll expander, which is problematic.

In view of this, an object of the present invention is to provide a scroll expander integrally including a communication passage (bypass passage) and a bypass valve configured to open and close the bypass passage without increasing the length in the shaft direction of the scroll expander so much.

Means for Solving the Problems

According to an aspect of the present invention, a scroll expander in which a fixed scroll and a movable scroll define an expansion chamber therebetween, and in which the movable scroll is configured to be driven by expansion of working fluid in the expansion chamber, includes a suction port, a discharge port, a bypass passage and a bypass valve. The suction port allows a high-pressure flow of the working fluid to enter, and guides the entering flow of the working fluid into the expansion chamber. The discharge port allows the working fluid expanded to a lower pressure in the expansion chamber to flow out. Through the bypass passage, the suction port communicates with the discharge port while bypassing the expansion chamber. The bypass valve is configured to open and close the bypass passage. The suction port, the bypass passage and a bypass valve attaching portion for attaching the bypass valve are formed in a base plate of the fixed scroll.

Effects of the Invention

In the scroll expander, the suction port, the bypass passage and the bypass valve attaching portion for attaching the bypass valve are formed in the base plate of the fixed scroll. This configuration eliminates the need for providing the back surface of the base plate of the fixed scroll with an additional member, such as a housing, for disposing these components in the scroll expander. Thus, the configuration can suppress an increase in length in the shaft direction of the scroll expander caused by disposing the components, and thus can achieve size reduction of the entire scroll expander as well as length reduction in the shaft direction of the scroll expander.

MODE FOR CARRYING OUT THE INVENTION

Hereinafter, an embodiment of the present invention will be described with reference to the attached drawings.

Figure 1:
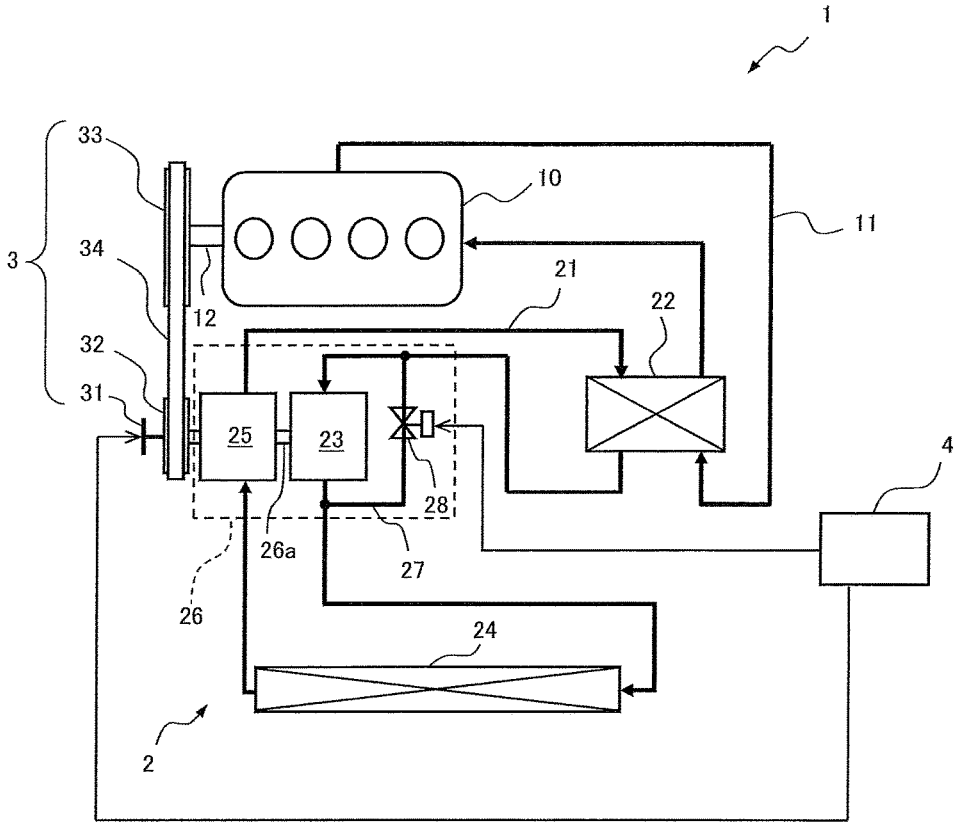
FIG. 1 is a schematic configuration diagram of a vehicle waste heat recovery system to which a scroll expander according to an embodiment of the present invention is applied.

FIG. 1 is a schematic configuration diagram of a vehicle waste heat recovery system 1 which employs a scroll expander according to an embodiment of the present invention. This vehicle waste heat recovery system 1 is configured to be installed in a vehicle so as to recover and use waste heat (including exhaust heat) from an engine 10 of the vehicle.

The vehicle waste heat recovery system 1 includes Rankine cycle 2, a transmission mechanism 3 and a control unit 4. The engine 10 is a water-cooled engine that is cooled by engine cooling water circulating through a cooling water flow channel (circuit) 11. A heater 22, which is a component of the Rankine cycle 2 to be described later, is disposed in the cooling water flow channel 11. The (high-temperature) engine cooling water having absorbed heat from the engine 10 flows through the heater 22.

The Rankine cycle 2 is configured to recover the waste heat of the engine 10 from the engine cooling water, to convert the waste heat into power (drive force), and to output the drive force. The Rankine cycle 2 has a refrigerant circuit 21 for allowing a refrigerant, which serves as working fluid, to circulate therethrough. In this refrigerant circuit 21, the heater 22, an expander 23, a condenser 24 and a pump 25 are disposed in this order in the circulation direction of the refrigerant.

The heater 22 is a heat exchanger configured to exchange heat between the (high-temperature) engine cooling water having absorbed heat from the engine 10 and the refrigerant in the Rankine cycle 2. This heat exchange process heats the refrigerant to turn into high-pressure superheated vapor. Though not illustrated in the attached drawings, in place of the engine cooling water, exhaust gas from the engine 10 may be caused to flow through the heater 22. In this case, the heater 22 is configured to exchange heat between the exhaust gas from the engine 10 and the refrigerant.

The expander 23 is a scroll expander configured to produce drive force by expanding the refrigerant that has been heated and turned into high-pressure superheated vapor (hereinafter referred to simply as "vapor refrigerant") by the heater 22. As will be described in detail later, the expander 23 has a fixed scroll and a movable scroll, which define an expansion chamber therebetween. The movable scroll is configured to be driven by the expansion of the vapor refrigerant in the expansion chamber. When driven, the movable scroll orbits. This orbiting motion of the movable scroll is converted into rotational motion of an output shaft which is outputted as drive force.

The condenser 24 is configured to exchange heat between outside air and the refrigerant flowing out of the expander 23, that is, the refrigerant having flowing through the expander 23 to be reduced in pressure. This heat exchange process cools and condenses (liquefies) the refrigerant. Though not illustrated in the attached drawings, a fan for blowing outside air toward the condenser 24 may additionally be provided.

The pump 25 is a mechanical pump configured to pump the refrigerant liquefied by the condenser 24 to the heater 22. The operation of the pump 25 causes the refrigerant to circulate through the components of the Rankine cycle 2, that is, through the heater 22, the expander 23 and the condenser 24.

In this embodiment, the expander (scroll expander) 23 and the pump (mechanical pump) 25 are integrally coupled together by way of a rotating shaft 26*a*, which are collectively configured as a pump integrated expander 26. Thus, the rotating shaft 26*a* of the pump integrated expander 26 functions both as the output shaft of the expander 23 and as a drive shaft for the pump 25. In this embodiment, the expander 23 is integrally provided with a bypass passage 27 and a bypass valve 28 (which will be described in detail later). The bypass passage 27 allows the refrigerant to circulate while bypassing the expansion chamber. The bypass valve 28 is configured to open and close the bypass passage 27. The control unit 4 controls the operation of the bypass valve 28, and thus the opening and closing of the bypass passage 27.

The transmission mechanism 3 transmits power between the engine 10 and the Rankine cycle 2. Specifically, the transmission mechanism 3 transmits the output torque of the engine 10 to the pump integrated expander 26 (pump 25), and transmits, as an output of the Rankine cycle 2, the torque (shaft torque) of the pump integrated expander 26 to the engine 10. The transmission mechanism 3 has a pulley 32, a crank pulley 33 and a belt 34. The pulley 32 is mounted on an end of the rotating shaft 26*a* of the pump integrated expander 26 with an electromagnetic clutch 31 interposed between. The crank pulley 33 is mounted on a crankshaft 12 of the engine 10. The belt 34 is tightly wrapped around the pulley 32 and the crank pulley 33. When the electromagnetic clutch 31 is turned ON (engaged), power is transmitted between the engine 10 and the Rankine cycle 2 (the pump integrated expander 26). When the electromagnetic clutch 31 is turned OFF (disengaged), the power transmission between the engine 10 and the Rankine cycle 2 (the pump integrated expander 26) is blocked. The control unit 4 controls the operation of the transmission mechanism 3, and thus the ON (engagement) and OFF (disengagement) of the electromagnetic clutch 31.

The control unit 4 controls the operation of the bypass valve 28 and the ON/OFF of the electromagnetic clutch 31, and thereby controls the operation of the Rankine cycle 2. For example, to activate the Rankine cycle 2, the control unit 4 first opens the bypass valve 28 and turns ON (engages) the electromagnetic clutch 31 so as to cause the engine 10 to drive the pump 25. This causes the refrigerant to circulate through the Rankine cycle 2 while bypassing the expansion chamber in the expander 23. When the pressure difference between the upstream and downstream sides of the expander 23 becomes not less than a predetermined value, the control unit 4 closes the bypass valve 28. This causes the refrigerant to circulate through the Rankine cycle 2 while flowing through the expansion chamber in the expander 23. As a result, the expander 23 starts to produce drive force. When the expander 23 produces a sufficient amount of drive force, part of the drive force drives the pump 25 and the rest of the drive force is transmitted to the engine 10 by way of the transmission mechanism 3 so as to assist the output (drive force) of the engine 10. To deactivate the Rankine cycle 2, the control unit 4 turns OFF (disengages) the electromagnetic clutch 31 and stops the pump 25 (thus stops the circulation of the refrigerant).

Next, description will be given of the expander (scroll expander) 23, that is, the expander unit in the pump integrated expander 26, according to this embodiment. Though will not be described in detail herein, the pump 25 (the pump unit in the pump integrated expander 26) may be a known mechanical pump (such as a gear pump or a vane pump) that can be coupled to the expander 23 by way of the rotating shaft 26*a*.

Figure 2:
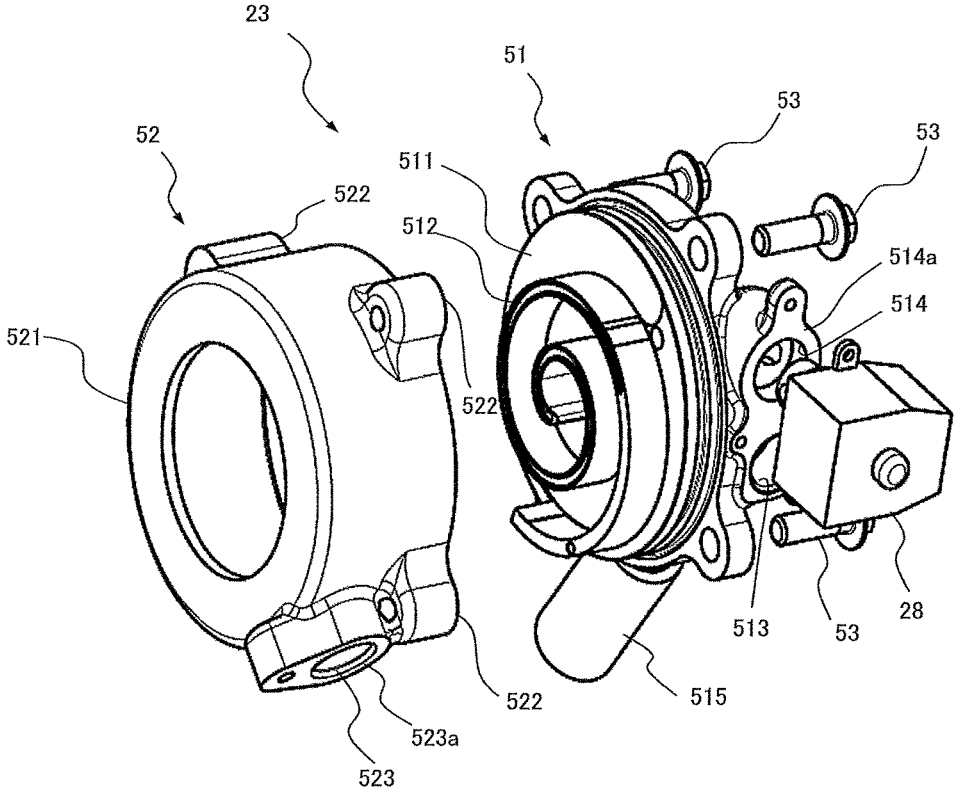
FIG. 2 is an exploded perspective view of the scroll expander.

FIG. 2 is an exploded perspective view of the expander 23.

As shown in FIG. 2, the expander 23 includes the fixed scroll 51 and a housing 52 that houses the movable scroll (not shown). The fixed scroll 51 has a circular disk-shaped base plate 511 and a scroll wall 512 formed on one surface of the base plate 511. The housing 52 has a cylindrical portion 521 and flange portions 522. The cylindrical portion 521 houses the movable scroll. The flange portions 522 are formed at an end of the cylindrical portion 521. Similarly to the fixed scroll 51, the movable scroll has a base plate and a scroll wall formed on one surface of the base plate.

The expander 23 is constructed by fixedly fastening, with, for example, bolts 53, the fixed scroll 51 onto the flange portions 522 of the housing 52 in which the cylindrical portion 521 houses the movable scroll. In the expander 23, the scroll wall 512 of the fixed scroll 51 engages with the scroll wall of the movable scroll, so as to define the expansion chamber between these scroll walls.

Though not illustrated in the attached drawings, an anti-rotation mechanism such as a ball coupling prevents the rotation of the movable scroll housed in the cylindrical portion 521 of the housing 52. In addition, the movable scroll is coupled to the output shaft of the expander 23 (that is, the rotating shaft 26*a* of the pump integrated expander 26) by way of an eccentric bearing, a driven crank mechanism and the like.

As described above, (the scroll wall 512 of) the fixed scroll 51 and (the scroll wall of) the movable scroll define the expansion chamber therebetween in the expander 23. The movable scroll is driven by expansion of the vapor refrigerant (that is, high-pressure refrigerant) in this expansion chamber. When driven, the movable scroll orbits, and the eccentric bearing, the driven crank mechanism and the like convert this orbiting motion of the movable scroll into rotational motion of the rotating shaft 26*a*. The expansion chamber allows the refrigerant to flow from its center portion to its peripheral portion while increasing the volume, so that the refrigerant flows out of the expander 23 after being expanded to a lower pressure in the expansion chamber (after reaching the peripheral portion).

Figure 3:
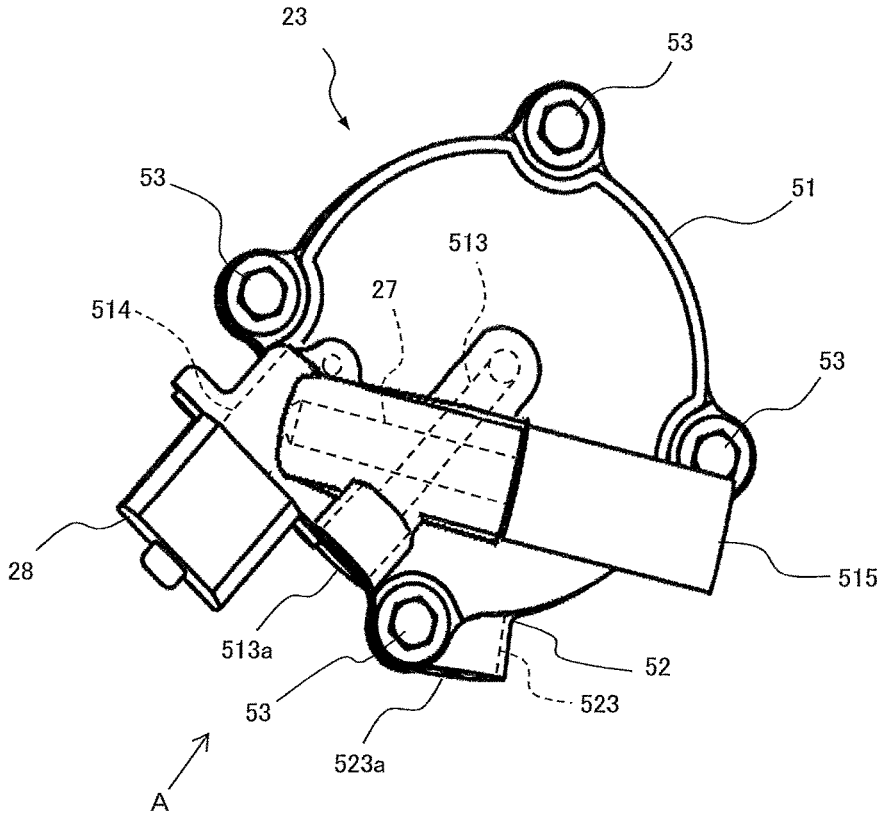
FIG. 3 is a perspective view of the scroll expander as viewed from near a fixed scroll.
Figure 4:
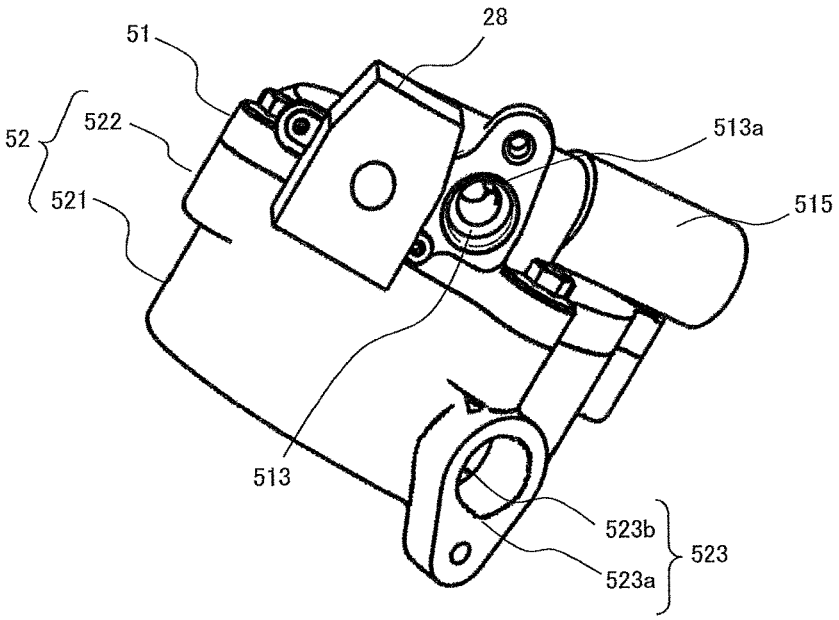
FIG. 4 is a view as viewed from arrow A of FIG. 3.

FIG. 3 is a perspective view of the expander 23 as viewed from near the fixed scroll 51. FIG. 4 is a view as viewed from arrow A of FIG. 3. As shown in FIG. 3, in this embodiment, the fixed scroll 51 is integrally provided with a suction port 513, the bypass passage 27 and the bypass valve 28. The suction port 513 allows a high-pressure flow of the refrigerant (including the vapor refrigerant) to enter, and guides the entering flow of the refrigerant into the expansion chamber. Specifically, the suction port 513, the bypass passage 27 and a bypass valve attaching portion 514 are formed in the base plate 511 of the fixed scroll 51, and the bypass valve 28 is attached to the bypass valve attaching portion 514. The configuration of the suction port 513, the bypass passage 27 and the bypass valve attaching portion 514 will be described later.

As shown in FIGS. 3 and 4, in this embodiment, a discharge port 523 is provided to the housing 52. The discharge port 523 allows the refrigerant expanded to a lower pressure in the expansion chamber (refrigerant reaching the peripheral portion) to flow out. Specifically, the discharge port 523 is formed so as to protrude from the peripheral wall of the cylindrical portion 521 of the housing 52. The discharge port 523 has an outer opening end 523*a*, which opens to the outside, and an inner opening end 523*b*, which opens to the inside through the inner periphery of the cylindrical portion 521. A refrigerant pipe that is connected at one end to the condenser 24 is connected at the other end to the outer opening end 523*a* of the discharge port 523 so as to guide the low-pressure refrigerant from the discharge port 523 to the condenser 24.

Next, description will be given of the configuration of the suction port 513, the bypass passage 27 and the bypass valve attaching portion 514 which are formed in the base plate 511 of the fixed scroll 51, with reference to FIGS. 5 to 8.

Figure 5:
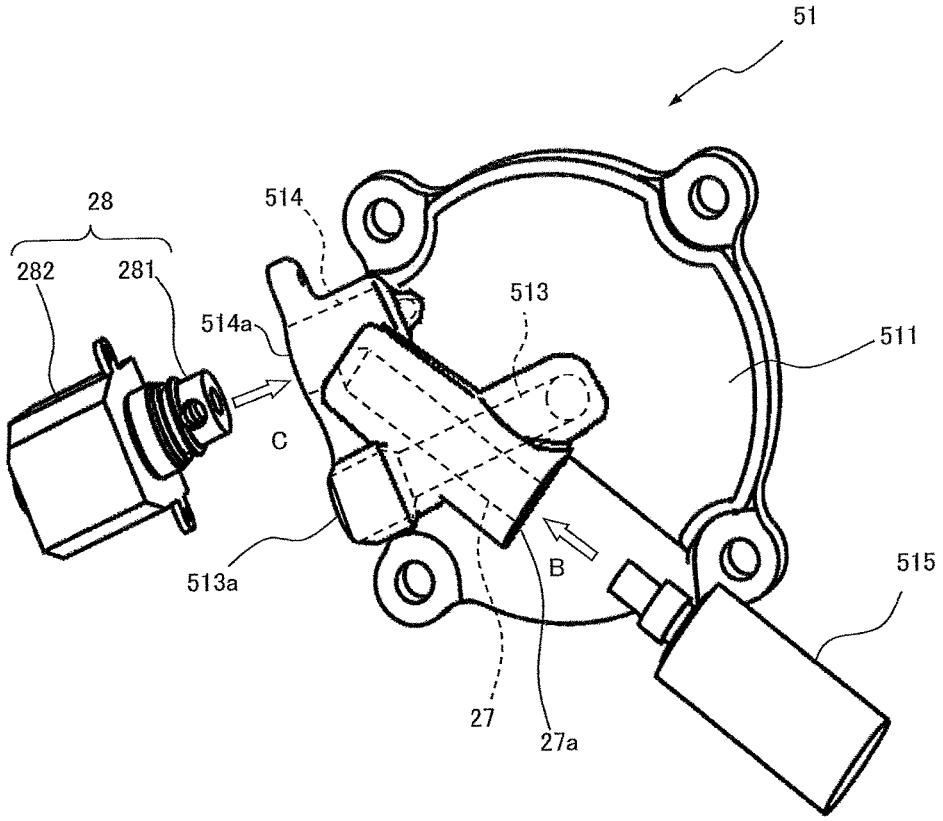
FIG. 5 is a view of the fixed scroll of the scroll expander as viewed from a scroll non-forming surface of a base plate.
Figure 6:
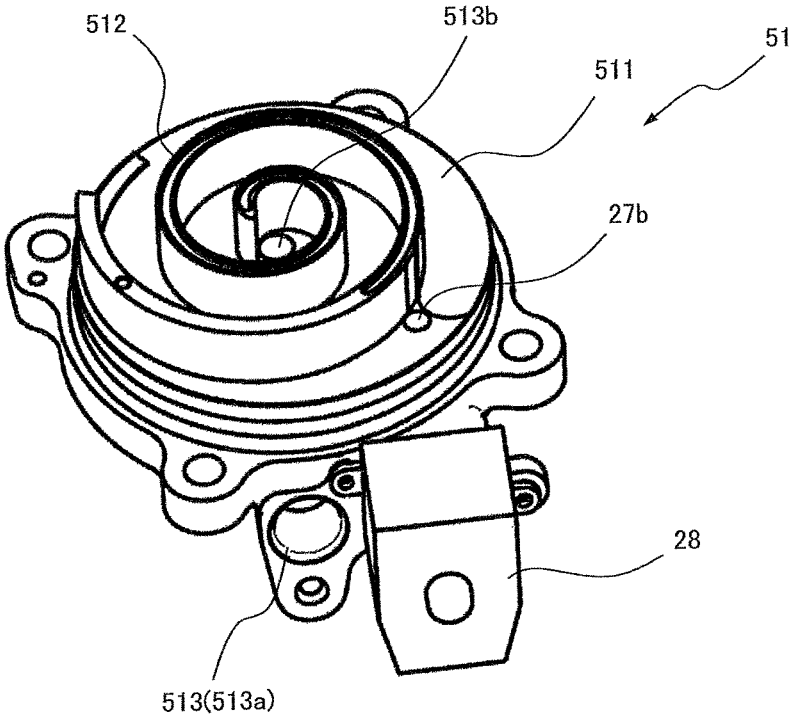
FIG. 6 is a perspective view of the fixed scroll as viewed from a scroll forming surface of the base plate.
Figure 7:
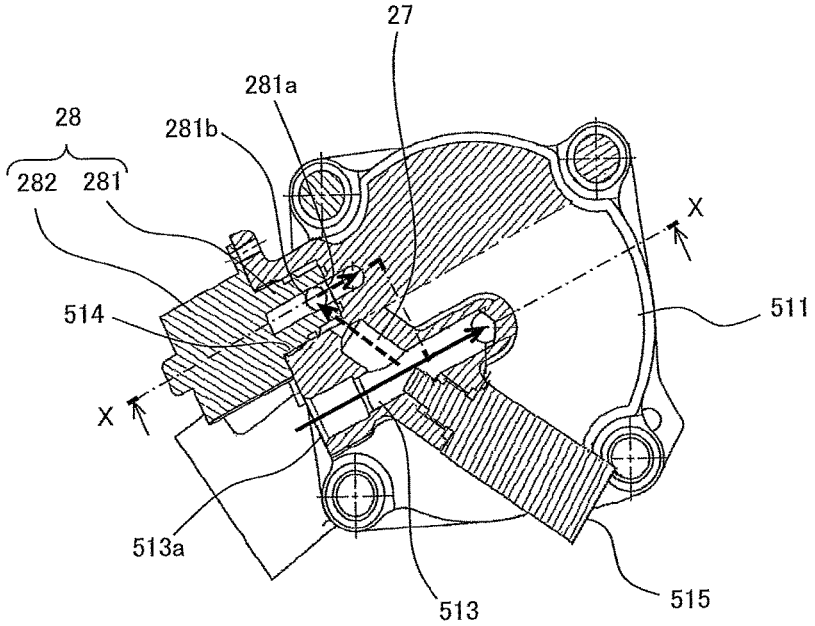
FIG. 7 is a cross-sectional view of the outline of a suction port, a bypass passage and a bypass valve attaching portion.
Figure 8:
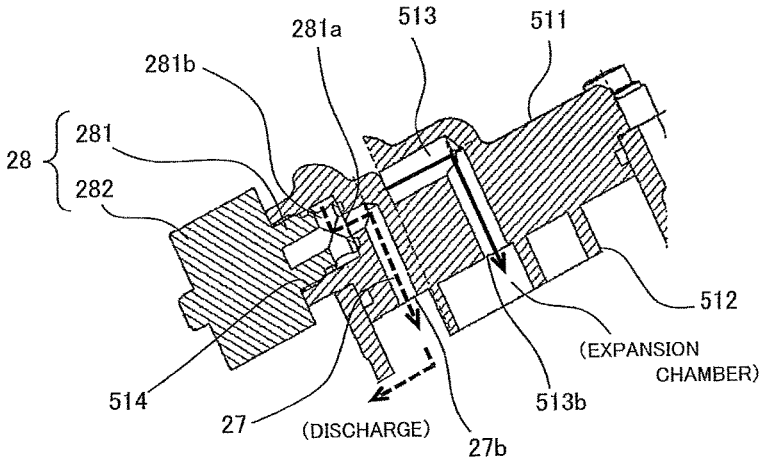
FIG. 8 is a cross-sectional view taken along X-X line of FIG. 7.

FIG. 5 is a view of the fixed scroll 51 as viewed from a scroll non-forming surface of the base plate 511. FIG. 6 is a perspective view of the fixed scroll 51 as viewed from a scroll forming surface of the base plate 511. FIGS. 7 and 8 are each a cross-sectional view of the outline of the suction port 513, the bypass passage 27 and the bypass valve attaching portion 514. In the following description, the one surface, on which the scroll wall 512 is formed, of the base plate 511 of the fixed scroll 51 will be referred to as "scroll forming surface," while the other surface, which is opposite to the scroll forming surface, of the base plate 511 will be referred to as "scroll non-forming surface."

The suction port 513 opens radially outwardly from the base plate 511 (thus, opens to the outside) at one end located near the periphery of the scroll non-forming surface of the base plate 511. Also, the suction port 513 opens at the other end located at the center of the scroll forming surface of the base plate 511 (the center of the scroll wall 512). Specifically, the suction port 513 has an outer opening end 513*a*, which is located near the periphery of the scroll non-forming surface of the base plate 511, and an inner opening end 513*b*, which is located at the center of the scroll forming surface of the base plate 511, and extends in the following way. From the outer opening end 513*a*, the suction port 513 extends along the scroll non-forming surface, and then curves near the center of the base plate 511 so as to pass through the base plate 511 to reach the inner opening end 513*b*. A refrigerant pipe that is connected at one end to the heater 22 is connected at the other end to the outer opening end 513*a* of the suction port 513 so as to guide the high-pressure refrigerant supplied from the heater 22 to the expansion chamber. The port wall of the suction port 513, or specifically, the port wall of a portion, extending along the scroll non-forming surface, of the suction port 513 is raised from the scroll non-forming surface.

In this embodiment, when the expander 23 is viewed in the axis direction of the rotating shaft (output shaft) 26*a*, the outer opening end 513*a* of the suction port 513 and the outer opening end 523*a* of the discharge port 523 are all disposed on one side of the expander 23. For example, when the expander 23 is viewed from the scroll non-forming surface of the base plate 511 of the fixed scroll 51, both the outer opening end 513*a* of the suction port 513 and the outer opening end 523*a* of the discharge port 523 are disposed on the left side of the expander 23 (see FIG. 3). This makes it possible to connect the refrigerant pipes to the expander 23 from the one side, thus facilitating this connection work than ever.

The bypass passage 27 is formed as a communication passage through which the suction port 513 communicates directly with the discharge port 523 of the housing 52 by bypassing the expansion chamber.

In this embodiment, the bypass passage 27 opens radially outwardly from the base plate 511 (thus, opens to the outside) at one end located near the center of the scroll non-forming surface of the base plate 511. Also, the bypass passage 27 opens at the other end located external to the scroll wall 512 in the scroll forming surface of the base plate 511. Specifically, the bypass passage 27 has an outer opening end 27*a*, which is located near the center of the scroll non-forming surface of the base plate 511, and an inner opening end 27*b*, which is located external to the scroll wall 512 in the scroll forming surface of the base plate 511, and extends in the following way. From the outer opening end 27*a*, the bypass passage 27 extends along the scroll non-forming surface across the suction port 513, and then curves near the periphery of the base plate 511 so as to pass through the base plate 511 to reach the inner opening end 27*b*.

Into the outer opening end 27*a* of the bypass passage 27, a condition detection sensor 515 is inserted in the direction indicated by arrow B of FIG. 5 so as to close the outer opening end 27*a*. The condition detection sensor 515 is configured to detect the condition of the refrigerant in the flow entering the suction port 513. In other words, the outer opening end 27*a* of the bypass passage 27 functions as a sensor attaching portion for attaching the condition detection sensor 515. Thus, the fixed scroll 51 is integrally provided with the condition detection sensor 515 in addition to the suction port 513, the bypass passage 27 and the bypass valve 28.

The condition detection sensor 515 is configured to detect the condition of the refrigerant in the flow entering the suction port 513 at the crossing of the suction port 513 and the bypass passage 27. For example, the condition detection sensor 515 may be a pressure/temperature sensor (PT sensor) configured to detect a refrigerant pressure P and a refrigerant temperature T near the inlet of the expander 23. In this embodiment, the outer opening end 27*a* of the bypass passage 27 is located near the center of the scroll non-forming surface of the base plate 511 so that, when inserted into this outer opening end 27*a*, the condition detection sensor 515 fits in the base plate 511, in other words, does not outwardly protrude from the outermost periphery of the base plate 511 (see FIG. 3).

Similarly to the suction port 513, the pipe wall of the bypass passage 27, or specifically, the pipe wall of a portion, extending along the scroll non-forming surface, of the bypass passage 27 is raised from the scroll non-forming surface.

The bypass valve attaching portion 514 is formed as a hole for inserting the bypass valve 28. Specifically, the bypass valve attaching portion 514 has an opening end 514*a* which is located near the periphery of the scroll non-forming surface of the base plate 511 so as to open laterally (outwardly) from the base plate 511, and extends in the following way. From the opening end 514*a*, the bypass valve attaching portion 514 extends along the scroll non-forming surface in communication with the bypass passage 27. In this embodiment, the bypass valve attaching portion 514 is formed in parallel to the suction port 513 in the scroll non-forming surface of the base plate 511 so that the outer opening end 513*a* of the suction port 513 opens to the same direction as the opening end 514*a* of the bypass valve attaching portion 514. In other words, in this embodiment, when the expander 23 is viewed in the axis direction of the rotating shaft (output shaft) 26*a*, the opening end 514*a* of the bypass valve attaching portion 514 as well as the outer opening end 513*a* of the suction port 513 and the outer opening end 523*a* of the discharge port 523 are all disposed on the one side (the left side in FIG. 3, for example) of the expander 23.

Similarly to the suction port 513 and the bypass passage 27, the peripheral wall of the bypass valve attaching portion 514 is raised from the scroll non-forming surface of the base plate 511.

The bypass valve 28 has a tip portion 281 and a main body 282. The bypass valve 28 is attached to the bypass valve attaching portion 514 with the tip portion 281 inserted into the opening end 514*a* of the bypass valve attaching portion 514 in the direction indicated by arrow C of FIG. 5. Since the opening end 514*a* of the bypass valve attaching portion 514 is located near the periphery of the base plate 511, the main body 282 of the bypass valve 28, which is exposed from the bypass valve attaching portion 514, is disposed lateral (external) to the base plate 511 of the fixed scroll 51.

The bypass valve 28 is constructed so that the tip portion 281 is located in the middle of the bypass passage 27. An opening 281*a* is formed in the outermost end of the tip portion 281. Additionally, a flow channel 281*b* is formed in the tip portion 281. The flow channel 281*b* communicates with the opening 281*a* so as to constitute the bypass passage 27 (see FIGS. 7 and 8). Though not illustrated in the attached drawings, the main body 282 internally includes a valve element and a valve drive unit (actuator) configured to drive the valve element. The valve element is movable so as to be pulled in and out in the direction toward and away from the opening 281*a*, which is formed in the outermost end of the tip portion 281.

The bypass valve 28 is configured to close and open the bypass passage 27 in accordance with instructions of the control unit 4. Specifically, the bypass valve 28 closes the bypass passage 27 by causing the valve drive unit to pull out the valve element so as to close the flow channel 281*b*. On the other hand, the bypass valve 28 opens the bypass passage 27 by causing the valve drive unit to pull in the valve element so as to open the flow channel 281*b*. When the bypass passage 27 is closed, the flow of the refrigerant having entered the suction port 513 travels through the suction port 513 while being guided to the expansion chamber through the inner opening end 513*b* of the suction port 513, as indicated by the solid lines of FIGS. 7 and 8. On the other hand, when the bypass passage 27 is opened, the flow of the refrigerant having entered the suction port 513 travels through the bypass passage 27 (thus bypasses the expansion chamber) while being guided to the discharge port 523, which is the low-pressure side, through the inner opening end 27*b* of the bypass passage 27, as indicated by the broken lines of FIGS. 7 and 8.

As described above, in the expander (scroll expander) 23 according to this embodiment, the fixed scroll 51 is integrally provided with the suction port 513, which allows the high-pressure flow of the refrigerant (working fluid) to enter and which guides the entering flow of the refrigerant into the expansion chamber; the bypass passage 27 which communicatively connects the suction port 513 to the discharge port 523 while bypassing the expansion chamber; and the bypass valve 28 configured to open and close the bypass passage 27. Specifically, the suction port 513, the bypass passage 27 and the bypass valve attaching portion 514 for attaching the bypass valve 28 are formed in the base plate 511 of the fixed scroll 51, and the bypass valve 28 is attached to the bypass valve attaching portion 514. This configuration eliminates the need for providing the back surface of the base plate 511 of the fixed scroll 51 with an additional member, such as a housing, for integrally disposing these components in the expander. Thus, the scroll expander according to this embodiment can be reduced in length in the shaft direction as compared to conventional scroll expanders.

Moreover, each of the suction port 513 and the bypass passage 27 extends along the scroll non-forming surface of the base plate 511 of the fixed scroll 51, and then curves to pass through the base plate 511 of the fixed scroll 51 till reaching the scroll forming surface. In addition, the bypass valve attaching portion 514 is formed as a hole for inserting the bypass valve 28 and extends along the scroll non-forming surface of the base plate 511 of the fixed scroll 51 in communication with the bypass passage 27. Thus, forming the suction port 513, the bypass passage 27 and the bypass valve attaching portion 514 in the base plate 511 of the fixed scroll 51 does not increase the length in the shaft direction of the expander 23 so much.

In the scroll non-forming surface of the base plate 511 of the fixed scroll 51, the bypass passage 27 crosses the suction port 513, and opens at the one end to the outside so as to have the outer opening end 27*a*. Moreover, the condition detection sensor 515 closes this outer opening end 27*a* of the bypass passage 27. This configuration makes it easier to form the bypass passage 27 in the base plate 511 of the fixed scroll 51 than when the one end is previously formed as a closed end. In addition, making the pass passage 27 open at the one end has another beneficial effect since it is equivalent to additionally forming the sensor attaching portion for attaching the condition detection sensor 515 to the base plate 511 of the fixed scroll 51.

In this embodiment, the suction port 513 opens to the outside at the one end located near the periphery of the scroll non-forming surface of the base plate 511 of the fixed scroll 51, and also opens at the other end located at the center of the scroll forming surface of the base plate 511 of the fixed scroll 51. Meanwhile, the bypass passage 27 opens to the outside at the one end located near the center of the scroll non-forming surface of the base plate 511 of the fixed scroll 51, and also opens at the other end located external to the scroll wall 512 in the scroll forming surface of the base plate 511 of the fixed scroll 51. In addition, the bypass valve attaching portion 514, formed as a hole, is located near the scroll non-forming surface of the base plate 511 of the fixed scroll 51. Moreover, the suction port 513 is formed in parallel to the bypass valve attaching portion 514 in the scroll non-forming surface of the base plate 511 of the fixed scroll 51.

This configuration allows for efficient arrangement of the suction port 513, the bypass passage 27 and the bypass valve attaching portion 514 in the base plate 511 of the fixed scroll 51, thus making it easier to form the fixed scroll 51 integrally provided with these components. In addition, the configuration allows the main body 282, which internally includes the valve drive unit of the bypass valve 28, to be disposed lateral (external) to the base plate 511 of the fixed scroll 51. Thus, attaching the bypass valve 28 to the base plate 511 of the fixed scroll 51 does not increase the length in the shaft direction of the expander 23 so much.

Moreover, in this embodiment, when the expander 23 is viewed in the axis direction of the rotating shaft (output shaft) 26*a*, the outer opening end 513*a* of the suction port 513, the opening end 514*a* of the bypass valve attaching portion 514 and the outer opening end 523*a* of the discharge port 523 are all disposed on the one side of the expander 23. This means that all the pipe connections and the protrusions of the expander 23 are concentrated on this one lateral side of the expander 23. Thus, this configuration facilitates the work of connecting the refrigerant pipes to the expander 23 as well as the securing of an installation space for the expander 23 as compared to conventional configurations.

In the above embodiment, the port wall of the suction port 513, the pipe wall of the bypass passage 27, and the peripheral wall of the bypass valve attaching portion 514 are raised from the scroll non-forming surface of the base plate 511 of the fixed scroll 51. This might cause the base plate 511 of the fixed scroll 51 to have a non-uniform stiffness. When the refrigerant is expanded, its expanding pressure is applied to the base plate 511. Thus, the non-uniform stiffness of the base plate 511 would cause non-uniform deformation in the base plate 511. Furthermore, this non-uniform deformation in the base plate 511 will change the clearance between the fixed scroll 51 and the movable scroll. This clearance change will cause the refrigerant to leak, thus degrading the performance of the expander 23. Sufficiently increased thickness of the base plate 511 can prevent or reduce this problematic non-uniform deformation in the base plate 511 caused by the expanding pressure of the refrigerant, but unfavorably increases the weight and the manufacturing cost of the expander 23.

Figure 9:
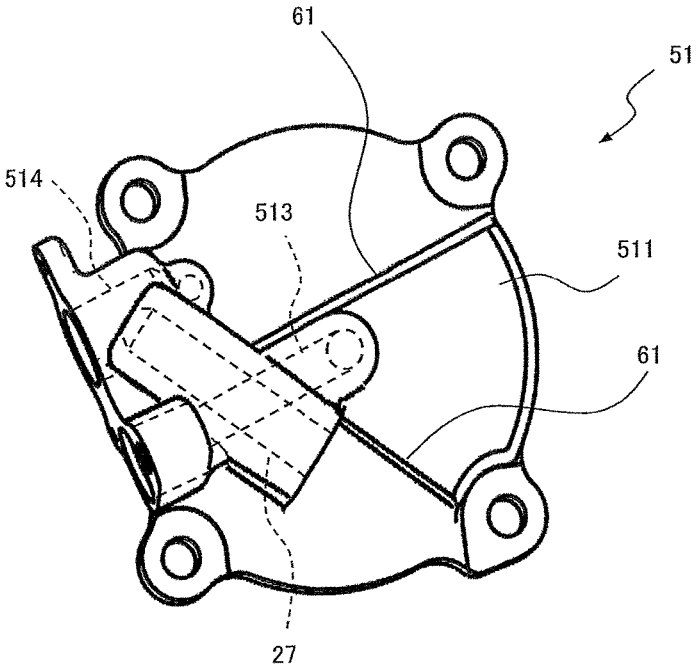
FIG. 9 illustrates a modification of the scroll expander.

To prevent or reduce the non-uniform stiffness of the base plate 511 while reducing the thickness of the base plate 511, a rib 61 may be formed on the scroll non-forming surface of the base plate 511 of the fixed scroll 51 as in a modification shown in FIG. 9. Specifically, at least one rib 61 is formed in an area including none of the suction port 513, the bypass passage 27 and the bypass valve attaching portion 514 on the scroll non-forming surface of the base plate 511 of the fixed scroll 51. The arrangement and the number of the rib(s) 61 may be appropriately selected. For example, the rib 61 may extend from or from near the port wall of the suction port 513 so as to be away from the outer opening end 513*a* of the suction port 513. Additionally or alternatively, the rib 61 may extend from or from near the outer opening end 27*a* of the bypass passage 27 so as to be away from the bypass passage 27. Forming the rib 61 makes it possible to secure the sufficient stiffness of the base plate 511 without increasing the thickness of the base plate 511 so much, and to prevent or reduce the non-uniform stiffness of the base plate 511.

In addition to or in place of forming the rib 61 on the scroll non-forming surface of the base plate 511 of the fixed scroll 51, the base plate 511 may have a non-uniform thickness so as to compensate for its non-uniform stiffness. In this case, a thick portion and/or a thin portion, which is different in thickness from the rest of the base plate 511, may be provided in the area including none of the suction port 513, the bypass passage 27 and the bypass valve attaching portion 514 in the base plate 511 of the fixed scroll 51.

Hereinabove, the embodiment and its modification according to the present invention have been described. However, the present invention is not limited to the embodiment and the modification described above, but, as a matter of course, further modifications and the like may be made based on the technical concept of the present invention.

For example, though integrally provided with the pump 25 in the above embodiment, the expander 23 may be integrally provided with a generator in place of or in addition to the pump 25. The expander 23 does not necessarily include the pump 25, the generator or the like (in other words, the expander 23 may be independent from those components). The expander 23 is not limited to one incorporated in the Rankine cycle 2.

REFERENCE SYMBOL LIST

1 Vehicle waste heat recovery system
2 Rankine cycle
21 Refrigerant circuit
22 Heater
23 Expander (Scroll expander)
24 Condenser
25 Pump
26 Pump integrated expander
26*a* Rotating shaft
27 Bypass passage
28 Bypass valve
51 Fixed scroll
52 Housing
61 Rib
511 Base plate of fixed scroll
512 Scroll wall of fixed scroll
513 Suction port
514 Bypass valve attaching portion
515 Condition detection sensor
523 Discharge port

The invention claimed is:

1. A scroll expander including a fixed scroll and a movable scroll which define an expansion chamber therebetween, the movable scroll being configured to be driven by expansion of working fluid in the expansion chamber, comprising:

a suction port which allows a high-pressure flow of the working fluid to enter, and which guides the entering flow of the working fluid into the expansion chamber;

a discharge port which allows the working fluid expanded to a lower pressure in the expansion chamber to flow out;

a bypass passage through which the suction port communicates with the discharge port while bypassing the expansion chamber; and a bypass valve configured to open and close the bypass passage, wherein:

the suction port, the bypass passage and a bypass valve attaching portion for attaching the bypass valve are formed in a base plate of the fixed scroll, both of the suction port and the bypass passage extend along a scroll non-forming surface, which is opposite to a scroll forming surface in which a scroll wall is formed, of the base plate of the fixed scroll, and then curves to pass through the base plate of the fixed scroll till reaching the scroll forming surface, the suction port and the bypass passage reaching different positions from each other in the scroll forming surface, and the bypass valve attaching portion is formed as a hole for inserting the bypass valve so as to extend along the scroll non-forming surface of the base plate of the fixed scroll in communication with the bypass passage.

2. The scroll expander according to claim 1, wherein in the scroll non-forming surface of the base plate of the fixed scroll, the bypass passage crosses the suction port, and opens at one end to an outside so as to have an outer opening end, and the outer opening end of the bypass passage is closed by a condition detection sensor that is configured to detect a condition of the working fluid in the flow entering the suction port.

3. The scroll expander according to claim 2, wherein the suction port opens to the outside at one end located near a periphery of the scroll non-forming surface of the base plate of the fixed scroll, and opens at the other end located at a center of the scroll forming surface of the base plate of the fixed scroll, the bypass passage opens to the outside at one end located near a center of the scroll non-forming surface of the base plate of the fixed scroll, and opens at the other end located external to the scroll wall in the scroll forming surface of the base plate of the fixed scroll, and the bypass valve attaching portion opens near the periphery of the scroll non-forming surface of the base plate of the fixed scroll.

4. The scroll expander according to claim 3, wherein the suction port is formed in parallel to the bypass valve attaching portion in the scroll non-forming surface of the base plate of the fixed scroll.

5. The scroll expander according to claim 3, wherein, when the scroll expander is viewed in an axis direction of a rotating shaft, an outer opening end of the suction port, an opening end of the bypass valve attaching portion, and an outer opening end of the discharge port are all disposed on one side of the scroll expander.

6. The scroll expander according to claim 1, wherein, at least either of at least one rib and at least one thick portion is formed in an area including none of the suction port, the bypass passage and the bypass valve attaching portion on the scroll non-forming surface of the base plate of the fixed scroll.

7. A scroll expander including a fixed scroll and a movable scroll which define an expansion chamber therebetween, the movable scroll being configured to be driven by expansion of working fluid in the expansion chamber, comprising:

a suction port which allows a high-pressure flow of the working fluid to enter, and which guides the entering flow of the working fluid into the expansion chamber;

a discharge port which allows the working fluid expanded to a lower pressure in the expansion chamber to flow out;

a bypass passage through which the suction port communicates with the discharge port while bypassing the expansion chamber; and a bypass valve configured to open and close the bypass passage, wherein:

the suction port, the bypass passage and a bypass valve attaching portion for attaching the bypass valve are formed in a base plate of the fixed scroll, both of the suction port and the bypass passage extend along a scroll non-forming surface, which is opposite to a scroll forming surface in which a scroll wall is formed, of the base plate of the fixed scroll, and then curves to pass through the base plate of the fixed scroll till reaching the scroll forming surface, the bypass valve attaching portion is formed as a hole for inserting the bypass valve so as to extend along the scroll non-forming surface of the base plate of the fixed scroll in communication with the bypass passage, and at least either of at least one rib and at least one thick portion is formed in an area including none of the suction port, the bypass passage and the bypass valve attaching portion on the scroll non-forming surface of the base plate of the fixed scroll.

* * * * *